US011083660B2

(12) United States Patent
Ader

(10) Patent No.: US 11,083,660 B2
(45) Date of Patent: Aug. 10, 2021

(54) CENTRIFUGAL BED ROTATOR

(71) Applicant: Vern Louis Ader, Waupaca, WI (US)

(72) Inventor: Vern Louis Ader, Waupaca, WI (US)

( * ) Notice: Subject to any disclaimer, the term of this patent is extended or adjusted under 35 U.S.C. 154(b) by 0 days.

(21) Appl. No.: 16/949,577

(22) Filed: Nov. 4, 2020

(65) Prior Publication Data

US 2021/0128388 A1 May 6, 2021

Related U.S. Application Data

(60) Provisional application No. 62/973,926, filed on Nov. 4, 2019.

(51) Int. Cl.
*A61H 1/00* (2006.01)
*A61H 1/02* (2006.01)

(52) U.S. Cl.
CPC ..... *A61H 1/0229* (2013.01); *A61H 1/001* (2013.01); *A61H 2201/0142* (2013.01); *A61H 2201/0165* (2013.01); *A61H 2201/0173* (2013.01); *A61H 2201/1215* (2013.01); *A61H 2203/0456* (2013.01)

(58) Field of Classification Search
CPC ..... A63G 1/26; A63G 1/28; A61H 1/0229; A61H 1/00; A61H 1/001; A61H 2203/0456
See application file for complete search history.

(56) References Cited

U.S. PATENT DOCUMENTS 2,017,099 A * 10/1935 Kuzel ..... A63G 1/18 472/29
2,239,944 A * 4/1941 Tobie ..... A63G 1/30 472/29
3,209,468 A * 10/1965 Frisch ..... B64G 7/00 434/59
3,436,841 A * 4/1969 Ritzinger ..... G09B 9/12 434/34
4,422,452 A 12/1983 Burton
4,524,763 A 6/1985 Eberling, Jr.
4,890,629 A * 1/1990 Isasi Capelo ..... A61H 1/001 128/897
4,896,659 A 1/1990 Goldish
(Continued)

FOREIGN PATENT DOCUMENTS

DE 3304005 A1 * 8/1984 ..... A61H 1/001
DE 3422059 A1 * 12/1985 ..... A61H 1/001
DE 10134195 A1 * 1/2003 ..... A61B 5/00

OTHER PUBLICATIONS

English translation for DE3422059, espacenet.com, translated on Apr. 15, 2021.*

(Continued)

*Primary Examiner* — Tu A Vo
(74) *Attorney, Agent, or Firm* — Dunlap Bennett & Ludwig, PLLC; Anna Kinney

(57) ABSTRACT

A centrifugal bed rotator is provided. The rotator includes a central pivot base; at least one riding arm attached at one end to the central pivot base; and a drive system attached to one end of the riding arm or the central pivot base drives the rotator with a support board having a wheel attached to the opposite end of the riding arm. The centrifugal bed rotator is useful for hypergravity therapy in health rehabilitation and exercise.

9 Claims, 4 Drawing Sheets

(56) References Cited

U.S. PATENT DOCUMENTS

| | | | | |
|---|---|---|---|---|
| 5,616,104 | A * | 4/1997 | Mulenburg | A63B 22/0605 472/21 |
| 5,931,739 | A * | 8/1999 | Layer | G09B 9/02 434/55 |
| 6,042,382 | A * | 3/2000 | Halfhill | A63G 1/26 434/55 |
| 8,152,699 | B1 | 4/2012 | Ma et al. | |
| 10,456,919 | B2 * | 10/2019 | Schluesselberger, Sr. | A61B 8/40 |
| 2006/0073956 | A1 | 4/2006 | Pandozy | |
| 2016/0228320 | A1 | 8/2016 | Mabry | |
| 2016/0354271 | A1 | 12/2016 | Ladozhskaya-Gapeenko et al. | |

OTHER PUBLICATIONS

English translation for DE10134195, espacenet.com, translated on Apr. 15, 2021.*
English translation for DE3304005, espacenet.com, translated on Apr. 15, 2021.*

* cited by examiner

CENTRIFUGAL BED ROTATOR

CROSS-REFERENCE TO RELATED APPLICATION

This application claims the benefit of priority of U.S. provisional application No. 62/973,926, filed Nov. 4, 2019, the contents of which are herein incorporated by reference.

BACKGROUND OF THE INVENTION

The present invention relates to a centrifugal rotator and, more particularly, to use thereof for hypergravity therapy for health rehabilitation and exercise.

Physical disabilities caused by many factors including illness, surgeries, accidents, etc., can leave individuals with limited mobility or with no movement. It is difficult for these individuals to exercise. There is no commercially available apparatus providing passive exercise for physically disabled persons.

Zero gravity has many negative effects on the human body as demonstrated by astronauts in space. A human-powered centrifuge was first developed by the National Aeronautics and Space Administration (NASA) to combat bone and muscle loss experienced by astronauts in zero gravity. See U.S. Pat. No. 5,616,104 to Mulenburg et al. The NASA-developed centrifuge is center pivot-driven with a motor gear box, is too costly for use by the public, and is not portable. Testing and research centrifuges have been developed for testing the effect of gravitational forces on the human body for pilots and astronauts. Such centrifuges have cost millions of dollars which has prevented the transfer of this beneficial technology to the general population at large.

Inactivity of persons on earth has similarly negative effects. The human centrifuge made for space conditioning of astronauts may have far reaching benefits for traditional rehabilitation, exercise, and conditioning of persons at all levels of health.

As can be seen, there is a need for a safe, low cost therapy system for persons of limited movement that speeds up healing and reduces recovery costs for all type of illness, surgery, disabled, inactive, aging and immobile persons, especially those with complications that limit or prevent moving or walking.

The present invention provides a passive exercise apparatus comprising a centrifuge having a central pivot base to which riding arms or beds are connected. The beds are also supported by components that are similar to components of a skateboard. The centrifuge increases gravitational forces on the body, i.e, induces hypergravity. This artificial hypergravity machine may provide comprehensive counter measures capable of improving all the user's physical systems at once (including muscles, joints, etc.), particularly when combined with other exercise. The inventive hypergravity apparatus may provide a total body low impact workout while comfortably and passively lying on a spinning centrifuge, as demonstrated by state-of-the-art NASA proven centrifuge systems.

The flexibility of the system enables operation at any speed, length of time, and direction, including intermittent operation, which makes it an ideal system for exercise and rehabilitation in numerous settings. The present invention may be used in settings selected from but not limited to the group consisting of: a rehabilitation center, a hospital, a nursing home, senior care, a hospital, a gym, a sport center, and a home.

SUMMARY OF THE INVENTION

In one aspect of the present invention, a centrifugal bed rotator is provided, comprising a central pivot base; at least one riding arm attached at a first end to the central pivot base; and a drive system attached to the at least one riding arm at a second end.

In another aspect of the present invention, a centrifugal bed rotator is provided, comprising a central pivot base; at least one riding arm attached to the central pivot base; and a support board having at least one wheel attached to a distal end of the at least one riding arm; wherein the central pivot base is operative to rotatably drive the centrifugal bed rotator.

These and other features, aspects and advantages of the present invention will become better understood with reference to the following drawings, description, and claims.

DETAILED DESCRIPTION OF THE INVENTION

Figure 1:
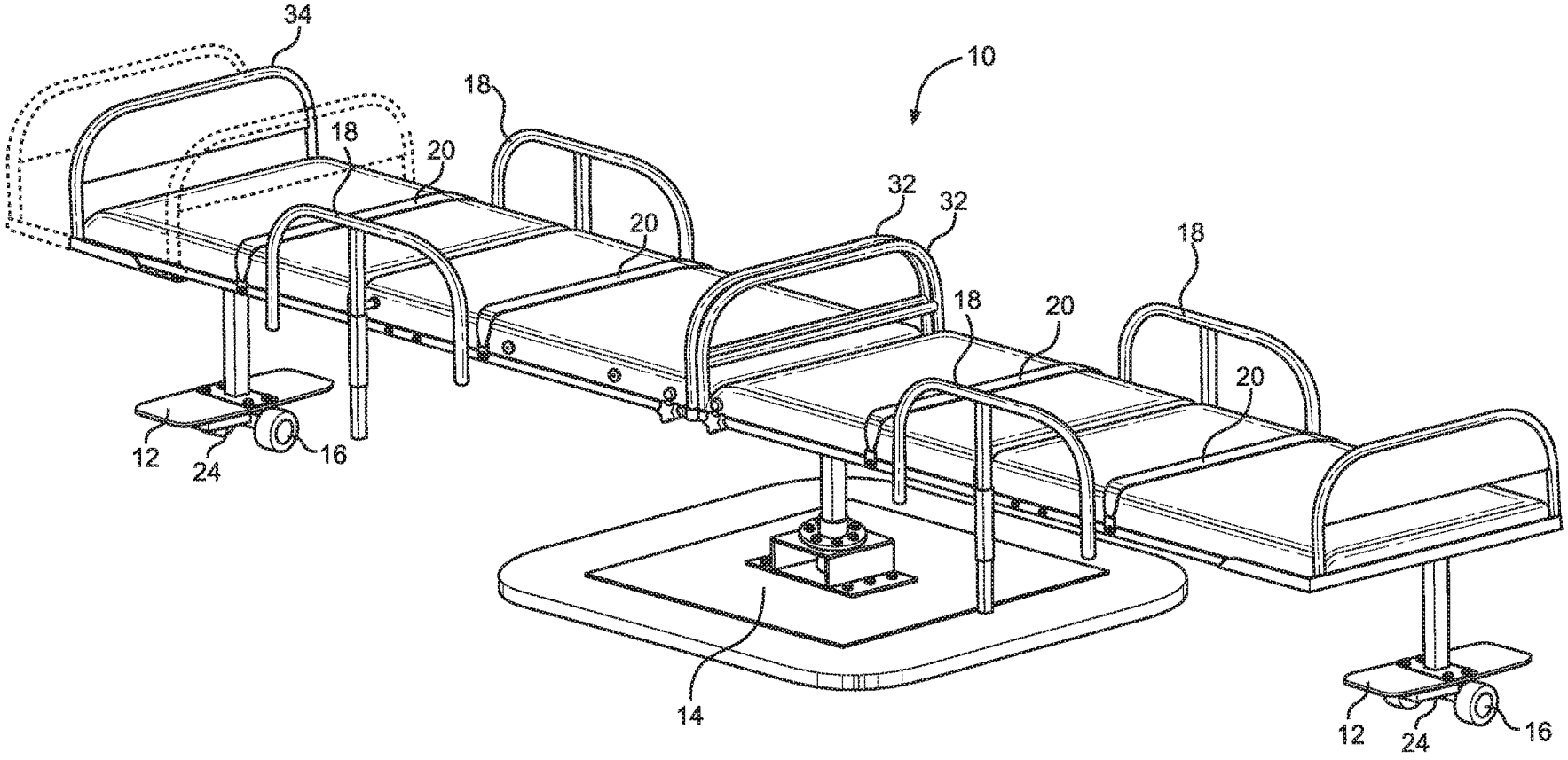
FIG. 1 is a perspective view of a centrifugal bed rotator according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

As used herein, the term "truck" refers to a baseplate connecting an axle with wheels to a board.

Broadly, one embodiment of the present invention is a centrifugal bed rotator system comprising a center pivot base and at least one riding arm attached thereto.

The centrifugal bed rotator system increases gravity (i.e., induces hypergravity) on a user for rehabilitation, conditioning, and low impact exercise. The user rides in a supine position without otherwise moving. When the user rides with his or her head facing the central platform, the user only feels pressure on the feet against a footrest. Preferably, the system provides a variable gravitational force equivalent (G-Force) loading from normal gravity (i.e., 1G, the force per unit mass due to gravity at the Earth's surface) to about 5 Gs, as measured at a point distal to the central pivot base, with variable speeds ranging from 0 rpms to about 50 rpms. The gravitational load on the body generally doubles when a person is rotated at about 20-23 rpm. The system generally draws blood toward the user's feet which stimulates the heart and blood circulation and is beneficial for persons with peripheral neuropathy and numerous other benefits.

The present invention provides a cost-effective centrifuge system for rehabilitation and for exercise for users of all ages and health levels. The hypergravity induced by the inventive centrifuge is believed to provide several benefits. Hypergravity is believed to cut down on exercise time for fitness, muscle, and bone strength, as well as to kickstart the metabolism. It is believed to assist with healing following developmental injury, brain injury, spinal cord injury, and numerous other injuries. For example, the inventive system is believed to provide spinal decompression for bulging discs, sciatica, stenosis, and vertebrae that are pinching nerves. Hypergravity may be used for therapy and physical conditioning for specific problems where persons are unable to use traditional methods of rehabilitation. It is believed to improve coordination and balance in elderly people with compromised coordination and balance. It is believed to restore muscle and bone by weight-loading the entire body, especially the lower extremities, without increasing the mass, forcing muscles to contract, and stimulating bone growth and strength. Hypergravity is believed to stimulate brain cells, thereby helping to recuperate some brain functions. It is also believed to increase lymph fluid flow that carries dead cells, metabolic waste, and toxins away from healthy tissue to be eliminated through sweat, mucus, urine, and liver bile.

The center pivot base may comprise a platform, a rod rising rotatably from the platform, and a bracket to which the riding arms may be attached. The riding arms according to the invention may attach to the rod and/or to the bracket. Each riding arm may be a bed, a bed frame, or a structural support for a bed.

In some embodiments, the drive system may comprise a driving board having wheels that are belt driven or motor-in-wheel driven, with power going to one or both wheels. The driving board may have a leg attached thereto to attach to the riding bed. The wheels may include, but are not limited to, truck wheels, outrigger wheels, or a combination thereof. The truck wheels may be placed in the center of the driving board, between the outrigger wheels. The driving board may also include a battery and/or electric speed control (ESC), as separate components or as an integral unit. The driving truck wheels may, in some cases, power one arm with a separate set of non-driving truck wheels supporting the end of each other arm attached to the central platform. In other cases, driving truck wheels may be provided to drive two or more arms. Generally, the wheels are mounted to the driving board in a direction tangent to the circumference of a circle defined by the outer portions of the centrifuge as it turns.

In some embodiments, the inventive system may have adjustable speed control, providing acceleration, deceleration, and/or intermittent operation, resulting in a variable gravitational force. Gravitational load may be adjusted according to the physical condition and needs of user.

In some embodiments, the inventive centrifugal bed rotator system may be operated using a handheld wireless variable speed control with start, stop, reverse, and a plurality of speed settings and/or a speed range control. In other words, the wireless controller may be operative to adjustably control the rotational speed. The rider may control the speed and time of operation while strapped into the riding pod. Alternatively, the speed and time of operation may be controlled by an attendant.

In some embodiments, a safety wand may provide automatic shut off to stop the system. The safety wand may also have power buttons for start, stop, reverse and speed modes. In other words, the safety wand may be operative to adjustably control the rotational speed.

In some embodiments, a drive system comprising a driving board, to which one or more wheels are rotatably attached, may be provided at an end of each riding arm. This drive system achieves balance and safety, reducing the physical space taken up by the system, and enables attachment of up to about four riding arms to the center pivot base. The additional riding arms expand the number of users that may concurrently use the system from one to four riders. In some cases, a set of arm support wheels may be mounted on each end of the driving board separately tangent to the circumference of the system rotation. For example, two wheels may be positioned adjacent opposite ends of the driving board. The orientation of a support wheel may vary based on its distance from the center of the driving board. This enables the wheels to track their individual circumferences of the centrifuge in either a clockwise or a counter-clockwise direction. The mounting brackets for both the driving and out rigger wheels may be adjusted to toe in for turning in one direction only, if desired.

In some embodiments, a riding arm attached to a center pivot base accommodates a bed or a riding pod. The riding pod may be form-fitting, low-profile for easy access, and/or cushioned. The length of the riding pod may be adjustable. A slidably adjustable end bed rail on the pod may be provided to accommodate various user heights. The riding pod may have one or more accessories, including but not limited to the group consisting of: a locking leg mechanism, slidably adjustable side handrails for safety (especially for the injured or weak user) and boarding from either side, and/or safety straps, such as a pair of adjustable safety belts. In some cases, the riding pod may accommodate an end-mounted battery powered drive train system.

In some embodiments, both the riding arm and the central platform have separable sections, which may reduce packing and shipping costs.

In some embodiments, the drive system may be battery powered, which may reduce construction costs.

In some embodiments, the system comprises a platform with adjustable rollers for moving the centrifuge system. For example, the platform may have roller bearing inserts. The platform may have a predetermined size and weight.

In some embodiments, the platform may further comprise anti-vibration pads for safety and smooth operation.

In some embodiments, an end of each riding arm may be supported by a board with free-rolling truck wheels or outrigger wheels. The wheels may be positioned to track individual circumferences of the centrifuge during operation.

In some embodiments, the system may have regenerative braking.

In some embodiments, a medical monitoring system may be provided to monitor the subject's vital signs.

In some embodiments, the centrifuge may include components and configurations selected from, but not limited to, the group consisting of: a mounting board, truck wheel configuration, various types of drive wheels, charging ports, universal serial bus (USB) ports, a power board, signal indicators, remote control indicators, and combinations thereof.

In some embodiments, the drive system may be powered from the center pivot base. In other words, the center pivot base may be operative to rotatably drive the centrifuge. An electric motor with a central gear box and control system may drive the centrifuge with power entering from below or above the center pivot drive. The other end (distal end) of each riding arm may have support wheels that support the arm and turn freely. The drive system may be operated by remote control or using an on-board controller. In some cases, the drive motor(s) may be battery powered.

Referring to FIGS. 1 through 6, FIGS. 1 and 3 show a centrifugal bed rotator 10 according to an embodiment of the present invention. The centrifugal bed rotator has a pair of riding arms 30 pivotally connected to a central base 14 at a first end 32. Each riding arm 30 is supported at a second end 34 by a driving board 12 which rides on a pair of wheels 16 connected to each driving board 12 by an axle 38. The driving boards 12 each hold a battery 24 adjacent to the wheels 16. As shown in FIG. 1, each riding arm 30 is adjustable in length in that a footrest at the second end 34 is slidably connected thereto. The riding arms 30 of FIG. 1 also have adjustable side handrails 18 along each longitudinal side and a pair of belt straps 20 evenly spaced along the length of the riding arm 30 for user 22 safety.

Figure 2:
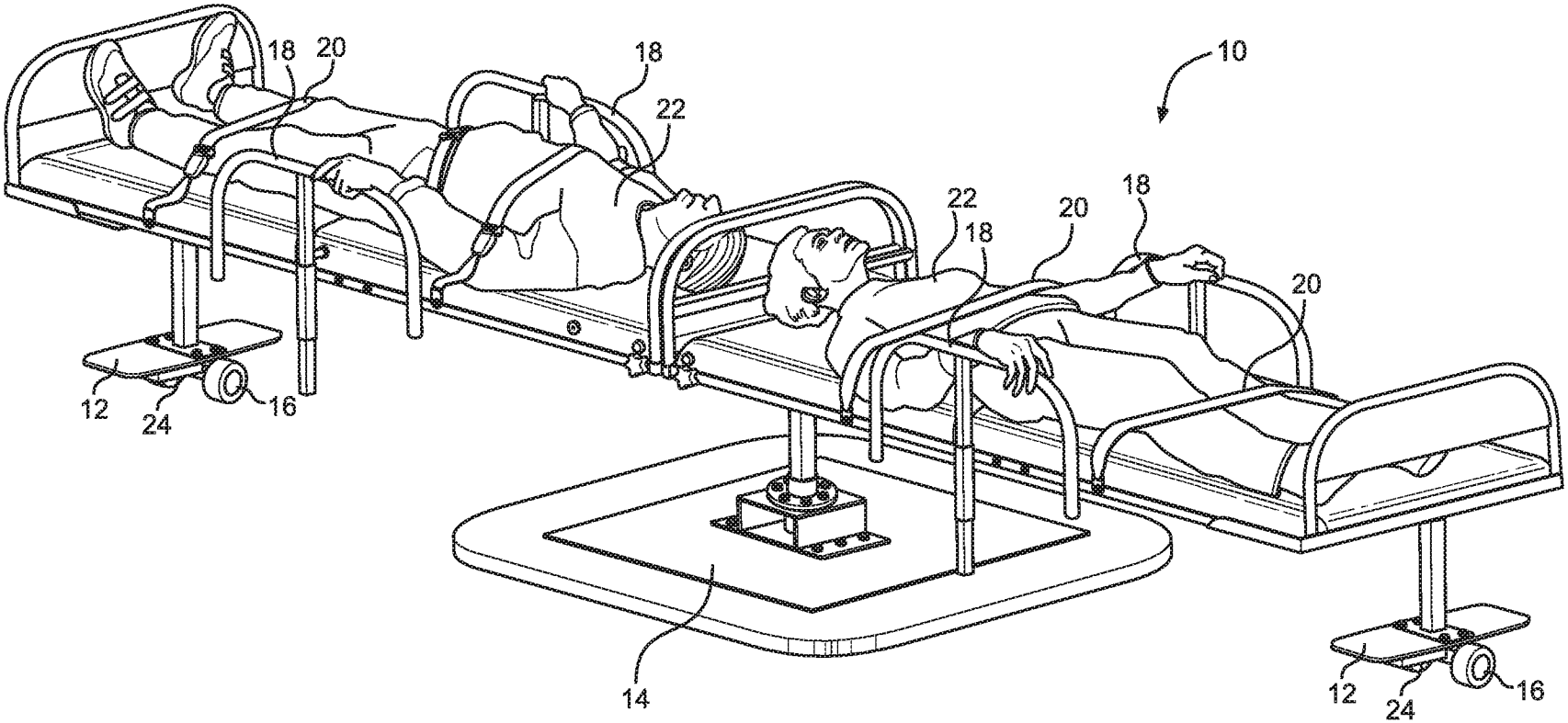
FIG. 2 is a perspective view thereof, shown in use.
Figure 3:
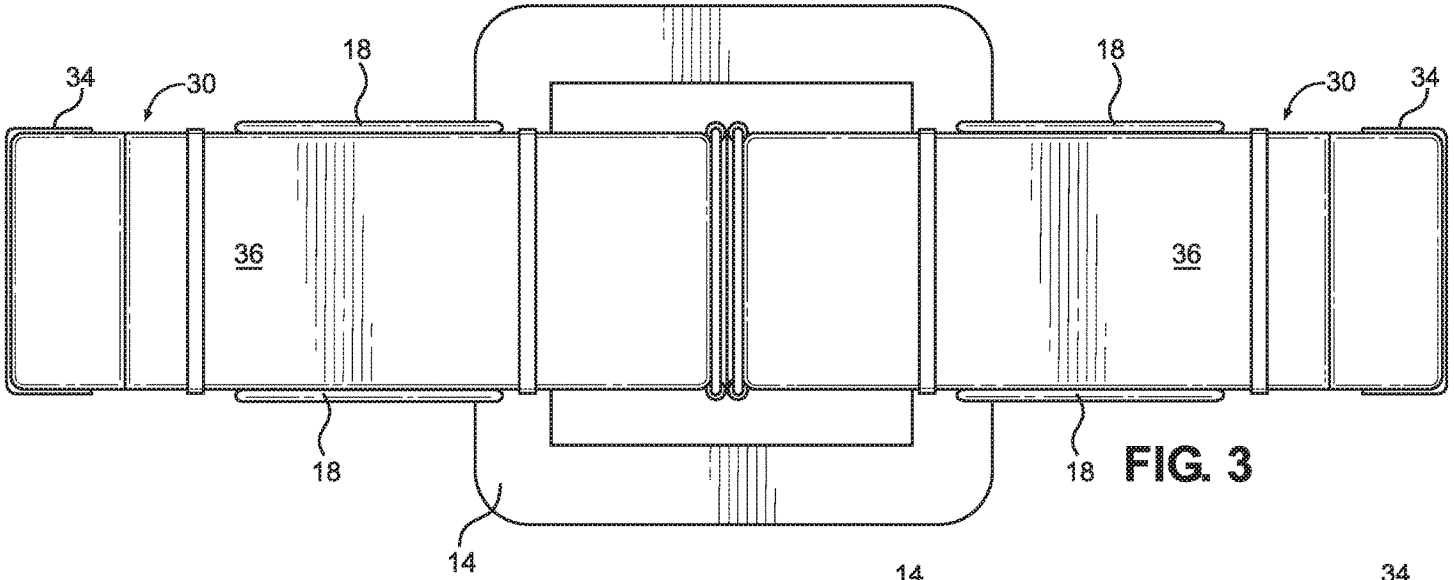
FIG. 3 is a top plan view thereof.
Figure 4:
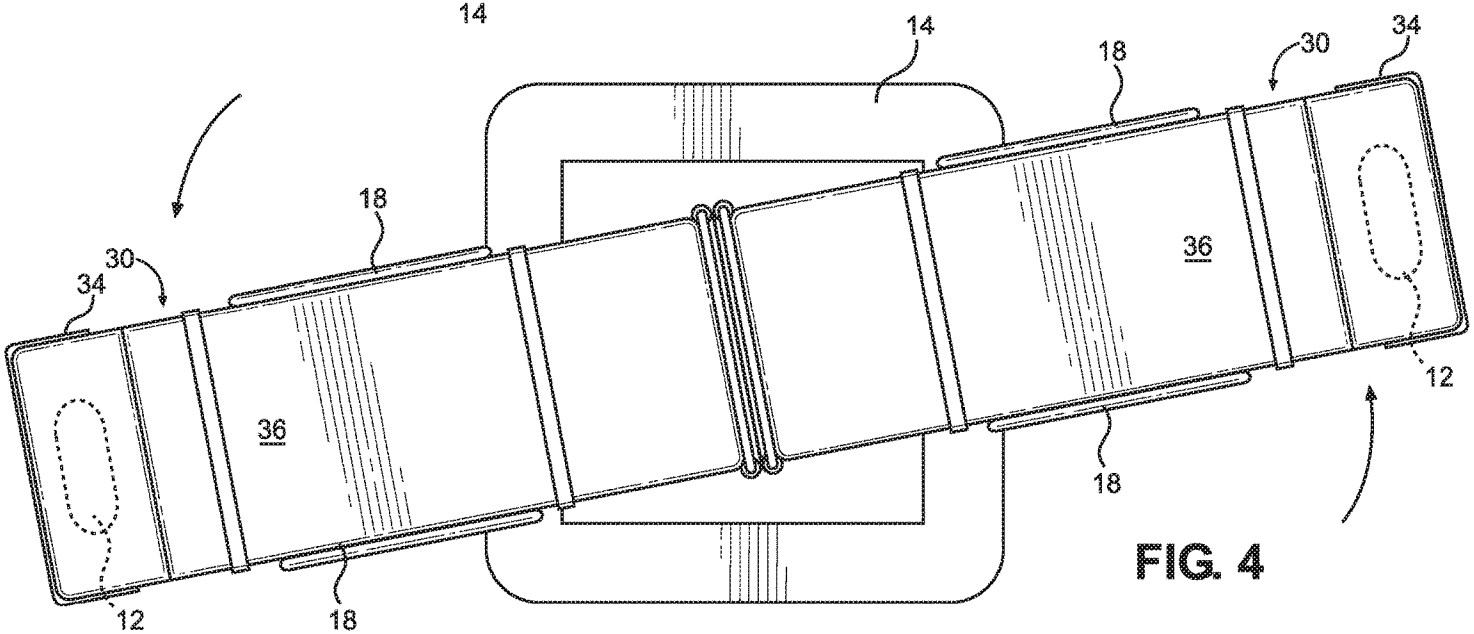
FIG. 4 is a top plan view, shown in motion.
Figure 5:
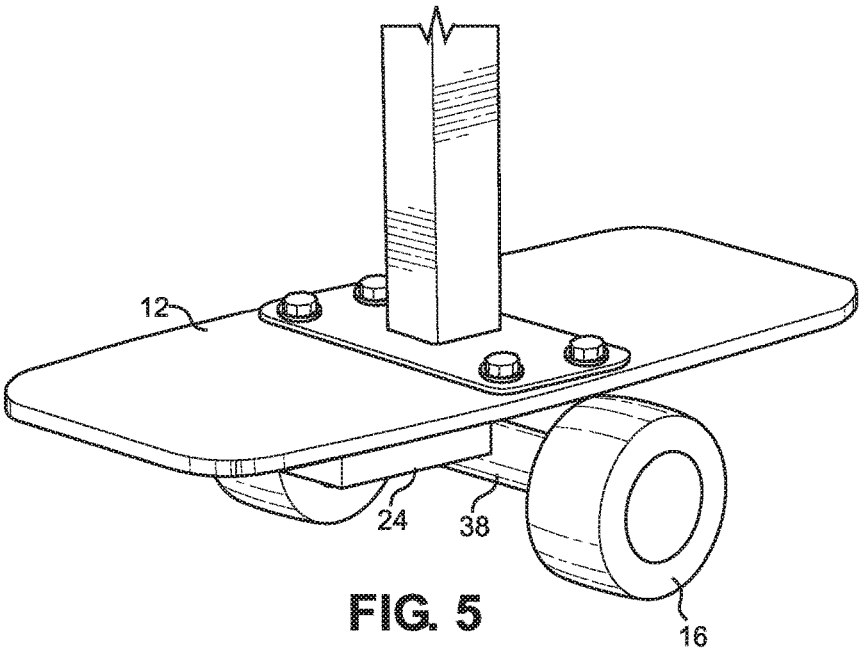
FIG. 5 is an enlarged view of a driving board thereof.
Figure 6:
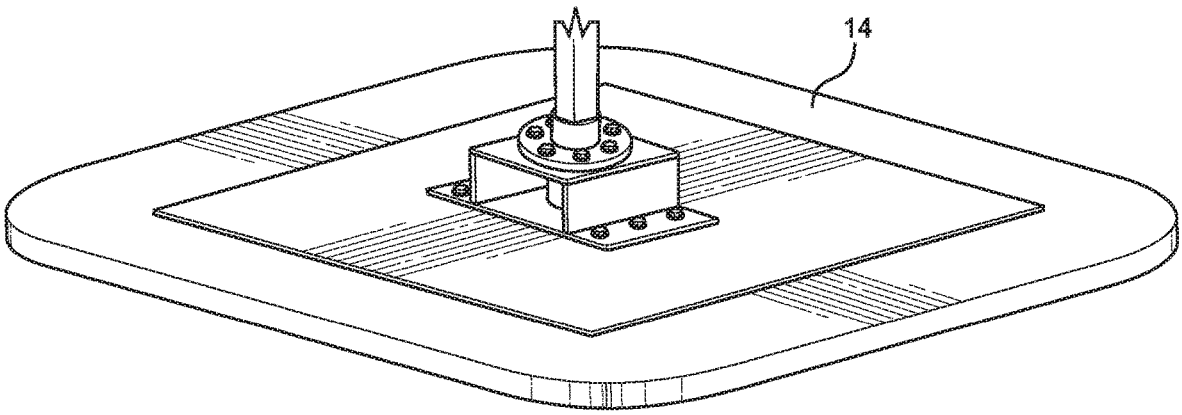
FIG. 6 is an enlarged view of a central base thereof.

FIG. 2 illustrates use of the centrifugal bed rotator 10 with two users 22. Each user 22 lies supine on top of a bed surface 36 (see FIG. 3) and secures the straps 20 across the chest and the legs. FIG. 4 illustrates the rotational movement of the pair of riding arms 30, turning on the central base 14 (see FIG. 6) and on the driving boards 12 (see FIG. 5) when operated with a wireless controller (not shown) or an on-board controller (not shown).

It should be understood, of course, that the foregoing relates to exemplary embodiments of the invention and that modifications may be made without departing from the spirit and scope of the invention as set forth in the following claims.

What is claimed is:

1. A centrifugal bed rotator comprising:

a) a central pivot base;

b) at least one riding arm rotatably attached to the central pivot base at a first end of the at least one riding arm about a vertical central rotating axis, wherein the at least one riding arm comprises a bed that is configured to support a user's body; c)

a vertical leg extending from a second end of the at least one riding arm and is configured to support the at least one riding arm at the second end; and d) a drive system comprising a driving board with a motor and at least one wheel, wherein an upper surface of the driving board is attached to the vertical leg, the at least one wheel is position below a bottom surface of the driving board, wherein the at least one wheel is configured to contact a floor, the at least one wheel and the motor is configured to rotate the at least one arm about the vertical central rotating axis by rotating the at least one wheel against the floor.

2. The centrifugal bed rotator of claim 1, wherein the at least one wheel is a belt-driven or the motor and the at least one wheel is configured as a motor-in-wheel configuration.

3. The centrifugal bed rotator of claim 1, wherein the at least one wheel comprises two wheels positioned adjacent opposite ends of the driving board.

4. The centrifugal bed rotator of claim 1, wherein the drive system further comprises a battery.

5. The centrifugal bed rotator of claim 1, wherein the bed having at least one component selected from the group consisting of: a slidably adjustable end rail; at least one slidably adjustable siderail; and at least one safety strap.

6. The centrifugal bed rotator of claim 1, wherein the central pivot base comprises a vibration and/or rollably moveable platform.

7. The centrifugal bed rotator of claim 1, wherein a rotational speed of the at least one riding arm is adjustable.

8. The centrifugal bed rotator of claim 1, wherein braking of the drive system comprises regenerative braking.

9. The centrifugal bed rotator of wherein a rotational speed of the at least one riding arm is adjustable, wherein braking of the drive system comprises regenerative braking, and the drive system further comprises a battery.

* * * * *